US011204224B2

(12) United States Patent
McNelis

(10) Patent No.: US 11,204,224 B2
(45) Date of Patent: Dec. 21, 2021

(54) REVERSE BURN POWER CHARGE FOR A WELLBORE TOOL

(71) Applicant: DynaEnergetics Europe GmbH, Troisdorf (DE)

(72) Inventor: Liam McNelis, Bonn (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/886,257

(22) Filed: May 28, 2020

(65) Prior Publication Data

US 2020/0378731 A1 Dec. 3, 2020

Related U.S. Application Data

(60) Provisional application No. 62/853,824, filed on May 29, 2019.

(51) Int. Cl.
*F42B 3/04* (2006.01)
*F42B 3/10* (2006.01)
(Continued)

(52) U.S. Cl.
CPC ..... *F42B 3/10* (2013.01); *E21B 23/04* (2013.01); *E21B 33/10* (2013.01);
(Continued)

(58) Field of Classification Search
None
See application file for complete search history.

(56) References Cited

U.S. PATENT DOCUMENTS 2,308,004 A 1/1943 Hart
2,618,343 A 11/1952 Conrad
(Continued)

FOREIGN PATENT DOCUMENTS

CA 2021396 A1 1/1991
CA 2848060 A1 10/2015
(Continued)

OTHER PUBLICATIONS

Schlumberger, CPST Pressure Setting Tool, 2014, 1 pg., https://www.slb.com/-/media/files/co/product-sheet/cpst-pressure-setting-tool.

(Continued)

*Primary Examiner* — Reginald S Tillman, Jr.
(74) *Attorney, Agent, or Firm* — Moyles IP, LLC

(57) ABSTRACT

A power charge and method for actuating a wellbore tool with a power charge. The power charge may include a first volume containing a first energetic material and a second volume containing a second energetic material positioned within the first energetic material. The second energetic material may be a faster burning material compared to the first energetic material. The wellbore tool may include a power charge cavity, an initiator positioned in an initiator holder adjacent to the power charge within the power charge cavity, and a gas diverter channel for directing to an expansion chamber gas pressure generated by combustion of the power charge, to actuate the wellbore tool. The method may include inserting the initiator into the intiator holder within the power charge cavity and initiating combustion of the first energetic material and the second energetic material.

19 Claims, 6 Drawing Sheets

(51) Int. Cl.

| | |
|---|---|
| ***E21B 23/04*** | (2006.01) |
| ***E21B 33/10*** | (2006.01) |
| ***F42B 3/26*** | (2006.01) |
| ***F42D 1/04*** | (2006.01) |
| ***E21B 41/00*** | (2006.01) |

(52) U.S. Cl.

CPC ..... *E21B 41/0085* (2013.01); *F42B 3/04* (2013.01); *F42B 3/26* (2013.01); *F42D 1/04* (2013.01)

(56) References Cited

U.S. PATENT DOCUMENTS

| | | | |
|---|---|---|---|
| 2,640,547 | A | 6/1953 | Baker et al. |
| 2,644,530 | A | 7/1953 | Baker |
| 2,681,114 | A | 6/1954 | Conrad |
| 2,692,023 | A | 10/1954 | Conrad |
| 2,695,064 | A | 11/1954 | Ragan et al. |
| 2,696,259 | A | 12/1954 | Greene |
| 2,713,910 | A | 7/1955 | Baker et al. |
| 2,769,701 | A | 11/1956 | Frederick |
| 2,799,343 | A | 7/1957 | Conrad |
| 2,807,325 | A | 9/1957 | Webb |
| 2,815,816 | A | 12/1957 | Baker |
| 2,979,904 | A | 4/1961 | Royer |
| 3,024,843 | A | 3/1962 | Dean |
| 3,026,939 | A | 3/1962 | Sweetman |
| 3,031,964 | A | 5/1962 | Chesnut |
| 3,036,636 | A | 5/1962 | Clark |
| 3,055,430 | A | 9/1962 | Campbell |
| 3,076,507 | A | 2/1963 | Sweetman |
| 3,094,166 | A | 6/1963 | Mccullough |
| 3,140,537 | A | 7/1964 | Popoff |
| 3,160,209 | A | 12/1964 | Bonner |
| 3,186,485 | A | 6/1965 | Owen |
| RE25,846 | E | 8/1965 | Campbell |
| 3,211,222 | A | 10/1965 | Myers |
| 3,220,480 | A | 11/1965 | Myers |
| 3,233,674 | A | 2/1966 | Kurt |
| 3,244,232 | A | 4/1966 | Myers |
| 3,264,994 | A | 8/1966 | Kurt |
| 3,266,575 | A | 8/1966 | Owen |
| 3,298,437 | A | 1/1967 | Conrad |
| 3,398,803 | A | 8/1968 | Kurt et al. |
| 3,498,376 | A | 3/1970 | Sizer et al. |
| 3,630,284 | A | 12/1971 | Fast et al. |
| 3,669,190 | A | 6/1972 | Sizer et al. |
| 3,691,954 | A | 9/1972 | Kern |
| 3,712,376 | A | 1/1973 | Young et al. |
| 3,762,470 | A | 10/1973 | Eggleston |
| 4,003,433 | A | 1/1977 | Goins |
| 4,058,061 | A | 11/1977 | Mansur, Jr. et al. |
| 4,064,935 | A | 12/1977 | Mohaupt |
| 4,172,421 | A | 10/1979 | Regalbuto |
| 4,250,960 | A | 2/1981 | Chammas |
| 4,269,120 | A | 5/1981 | Brede et al. |
| 4,317,413 | A | 3/1982 | Strandli et al. |
| 4,429,741 | A | 2/1984 | Hyland |
| 4,485,741 | A | 12/1984 | Moore et al. |
| 4,512,418 | A | 4/1985 | Regalbuto et al. |
| 4,530,396 | A | 7/1985 | Mohaupt |
| 4,535,842 | A | 8/1985 | Ross |
| 4,609,056 | A | 9/1986 | Colle, Jr. et al. |
| 4,619,318 | A | 10/1986 | Terrell et al. |
| 4,620,591 | A | 11/1986 | Terrell et al. |
| 4,662,450 | A | 5/1987 | Haugen |
| 4,754,812 | A | 7/1988 | Gentry |
| 4,798,244 | A | 1/1989 | Trost |
| 4,840,231 | A | 6/1989 | Berzin et al. |
| 4,852,647 | A | 8/1989 | Mohaupt |
| 4,869,325 | A | 9/1989 | Halbardier |
| 5,024,270 | A | 6/1991 | Bostick |
| 5,046,567 | A | 9/1991 | Aitken et al. |
| 5,211,224 | A | 5/1993 | Bouldin |
| 5,303,772 | A | 4/1994 | George et al. |
| 5,316,087 | A | 5/1994 | Manke et al. |
| 5,392,860 | A | 2/1995 | Ross |
| 5,396,951 | A | 3/1995 | Ross |
| 5,398,760 | A | 3/1995 | George et al. |
| 5,447,202 | A | 9/1995 | Littleford |
| 5,456,319 | A | 10/1995 | Schmidt et al. |
| 5,509,480 | A | 4/1996 | Terrell et al. |
| 5,511,620 | A | 4/1996 | Baugh et al. |
| 5,575,331 | A | 11/1996 | Terrell |
| 5,732,869 | A | 3/1998 | Hirtl |
| 5,831,204 | A | 11/1998 | Lubben et al. |
| 6,082,450 | A | 7/2000 | Snider et al. |
| 6,102,120 | A | 8/2000 | Chen et al. |
| 6,112,666 | A | 9/2000 | Murray et al. |
| 6,164,375 | A | 12/2000 | Carisella |
| 6,227,116 | B1 | 5/2001 | Dumenko |
| 6,272,782 | B1 | 8/2001 | Dittrich et al. |
| 6,349,767 | B2 | 2/2002 | Gissler |
| 6,385,031 | B1 | 5/2002 | Lerche et al. |
| 6,414,905 | B1 | 7/2002 | Owens et al. |
| 6,435,096 | B1 | 8/2002 | Watson |
| 6,467,387 | B1 | 10/2002 | Espinosa et al. |
| 6,502,736 | B2 | 1/2003 | Dittrich et al. |
| 6,591,753 | B1 | 7/2003 | Schmid et al. |
| 6,702,009 | B1 | 3/2004 | Drury et al. |
| 6,719,061 | B2 | 4/2004 | Muller et al. |
| 6,739,265 | B1 | 5/2004 | Badger et al. |
| 6,752,083 | B1 | 6/2004 | Lerche et al. |
| 6,817,298 | B1 | 11/2004 | Zharkov et al. |
| 6,880,637 | B2 | 4/2005 | Myers, Jr. et al. |
| 7,017,672 | B2 | 3/2006 | Owen, Sr. |
| 7,073,589 | B2 | 7/2006 | Tiernan et al. |
| 7,086,481 | B2 | 8/2006 | Hosie et al. |
| 7,104,323 | B2 | 9/2006 | Cook et al. |
| 7,128,162 | B2 | 10/2006 | Quinn |
| 7,228,906 | B2 | 6/2007 | Snider et al. |
| 7,243,722 | B2 | 7/2007 | Oosterling et al. |
| 7,246,548 | B2 | 7/2007 | Kash |
| 7,278,482 | B2 | 10/2007 | Azar |
| 7,428,932 | B1 | 9/2008 | Wintill et al. |
| 7,431,075 | B2 | 10/2008 | Brooks et al. |
| 7,487,827 | B2 | 2/2009 | Tiernan |
| 7,493,945 | B2 | 2/2009 | Doane et al. |
| 7,510,017 | B2 | 3/2009 | Howell et al. |
| 7,533,722 | B2 | 5/2009 | George et al. |
| 7,574,960 | B1 | 8/2009 | Dockery et al. |
| 7,604,062 | B2 | 10/2009 | Murray |
| 7,721,650 | B2 | 5/2010 | Barton et al. |
| 7,748,457 | B2 | 7/2010 | Walton et al. |
| 7,778,006 | B2 | 8/2010 | Stewart et al. |
| 7,779,926 | B2 | 8/2010 | Turley et al. |
| 7,823,508 | B2 | 11/2010 | Anderson et al. |
| 7,896,077 | B2 | 3/2011 | Behrmann et al. |
| 7,905,290 | B2 | 3/2011 | Schicks |
| 8,141,639 | B2 | 3/2012 | Gartz et al. |
| 8,186,425 | B2 | 5/2012 | Smart et al. |
| 8,230,946 | B2 | 7/2012 | Crawford et al. |
| 8,322,426 | B2 | 12/2012 | Wright et al. |
| 8,397,741 | B2 | 3/2013 | Bisset |
| 8,464,624 | B2 | 6/2013 | Asahina et al. |
| 8,474,381 | B2 | 7/2013 | Streibich et al. |
| 8,474,533 | B2 | 7/2013 | Miller et al. |
| 8,522,863 | B2 | 9/2013 | Tiernan et al. |
| 8,561,683 | B2 | 10/2013 | Wood et al. |
| 8,695,716 | B2 | 4/2014 | Ravensbergen |
| 8,752,486 | B2 | 6/2014 | Robertson et al. |
| 8,826,821 | B2 | 9/2014 | Martin |
| 8,881,816 | B2 | 11/2014 | Glenn et al. |
| 8,881,836 | B2 | 11/2014 | Ingram |
| 8,950,480 | B1 | 2/2015 | Strickland |
| 9,057,261 | B2 | 6/2015 | Walters et al. |
| 9,080,405 | B2 | 7/2015 | Carisella |
| 9,182,199 | B2 | 11/2015 | Skidmore et al. |
| 9,222,331 | B2 | 12/2015 | Schneidmiller et al. |
| 9,285,199 | B2 | 3/2016 | Beikoff |
| 9,328,559 | B2 | 5/2016 | Schwarz et al. |
| 9,453,381 | B2 | 9/2016 | Moyes |
| 9,453,382 | B2 | 9/2016 | Carr et al. |
| 9,464,495 | B2 | 10/2016 | Picciotti et al. |

(56) References Cited

U.S. PATENT DOCUMENTS

| | | | |
|---|---|---|---|
| 9,476,272 | B2 | 10/2016 | Carisella et al. |
| 9,476,275 | B2 | 10/2016 | Wells et al. |
| 9,476,289 | B2 | 10/2016 | Wells |
| 9,482,069 | B2 | 11/2016 | Powers |
| 9,488,024 | B2 | 11/2016 | Hoffman et al. |
| 9,506,316 | B2 | 11/2016 | Carr et al. |
| 9,587,466 | B2 | 3/2017 | Burguieres et al. |
| 9,598,942 | B2 | 3/2017 | Wells et al. |
| 9,689,240 | B2 | 6/2017 | LaGrange et al. |
| 9,695,673 | B1 | 7/2017 | Latiolais |
| 9,771,769 | B2 | 9/2017 | Baker et al. |
| 9,810,035 | B1 | 11/2017 | Carr et al. |
| 9,822,609 | B2 | 11/2017 | Wright et al. |
| 9,835,006 | B2 | 12/2017 | George et al. |
| 9,879,501 | B2 | 1/2018 | Hammer et al. |
| 9,890,604 | B2 | 2/2018 | Wood et al. |
| 9,926,765 | B2 | 3/2018 | Goodman et al. |
| 9,963,398 | B2 | 5/2018 | Greeley et al. |
| 9,995,115 | B2 | 6/2018 | Kasperski |
| 10,018,018 | B2 | 7/2018 | Cannon et al. |
| 10,036,236 | B1 | 7/2018 | Sullivan et al. |
| 10,041,321 | B2 | 8/2018 | Oag et al. |
| 10,077,626 | B2 | 9/2018 | Xu et al. |
| 10,087,708 | B2 | 10/2018 | Al-Gouhi et al. |
| 10,107,054 | B2 | 10/2018 | Drury et al. |
| 10,167,691 | B2 | 1/2019 | Zhang et al. |
| 10,246,961 | B2 | 4/2019 | Robertson et al. |
| 10,267,603 | B2 | 4/2019 | Marshall et al. |
| 10,365,079 | B2 | 7/2019 | Harrington et al. |
| 10,393,482 | B2 * | 8/2019 | Khatiwada ..... E21B 23/065 |
| 10,428,595 | B2 | 10/2019 | Bradley et al. |
| 10,538,981 | B2 | 1/2020 | Covalt et al. |
| 10,605,018 | B2 | 3/2020 | Schmidt et al. |
| 10,689,931 | B2 | 6/2020 | Mickey et al. |
| 10,830,566 | B2 | 11/2020 | Maxted et al. |
| 10,883,327 | B1 | 1/2021 | Drury et al. |
| 10,927,627 | B2 | 2/2021 | Eitschberger et al. |
| 10,941,625 | B2 | 3/2021 | Mickey |
| 2002/0129940 | A1 | 9/2002 | Yang et al. |
| 2003/0155112 | A1 | 8/2003 | Tiernan et al. |
| 2005/0183610 | A1 | 8/2005 | Barton et al. |
| 2006/0048664 | A1 | 3/2006 | Tiernan et al. |
| 2006/0075890 | A1 | 4/2006 | Tiernan |
| 2006/0081374 | A1 | 4/2006 | Bland et al. |
| 2008/0173204 | A1 | 7/2008 | Anderson et al. |
| 2010/0307773 | A1 | 12/2010 | Tinnen et al. |
| 2012/0080202 | A1 | 4/2012 | Greenlee et al. |
| 2012/0241169 | A1 | 9/2012 | Hales et al. |
| 2014/0060839 | A1 | 3/2014 | Wang et al. |
| 2014/0209381 | A1 | 7/2014 | Huang et al. |
| 2014/0318766 | A1 | 10/2014 | Bishop |
| 2015/0176386 | A1 | 6/2015 | Castillo et al. |
| 2015/0226533 | A1 | 8/2015 | Grattan |
| 2015/0247375 | A1 | 9/2015 | Stout |
| 2015/0356403 | A1 | 12/2015 | Storm, Jr. |
| 2016/0053560 | A1 | 2/2016 | Drury et al. |
| 2016/0145990 | A1 | 5/2016 | Mace et al. |
| 2016/0153271 | A1 | 6/2016 | Mace et al. |
| 2016/0153272 | A1 | 6/2016 | Mace et al. |
| 2016/0186511 | A1 | 6/2016 | Coronado et al. |
| 2016/0186513 | A1 | 6/2016 | Robertson et al. |
| 2017/0009560 | A1 | 1/2017 | Wells |
| 2017/0030162 | A1 | 2/2017 | Carragher |
| 2017/0037716 | A1 | 2/2017 | Kohlik |
| 2017/0044865 | A1 | 2/2017 | Sabins et al. |
| 2017/0138150 | A1 | 5/2017 | Yencho |
| 2017/0241244 | A1 | 8/2017 | Barker et al. |
| 2017/0328134 | A1 | 11/2017 | Sampson et al. |
| 2017/0335646 | A1 | 11/2017 | Huang et al. |
| 2018/0080298 | A1 | 3/2018 | Covalt et al. |
| 2018/0080300 | A1 | 3/2018 | Angstmann et al. |
| 2018/0087330 | A1 | 3/2018 | Bradley et al. |
| 2018/0106121 | A1 | 4/2018 | Griffin et al. |
| 2018/0120066 | A1 | 5/2018 | Khatiwada et al. |
| 2018/0127641 | A1 | 5/2018 | Nguyen et al. |
| 2018/0148995 | A1 | 5/2018 | Burky et al. |
| 2018/0171757 | A1 | 6/2018 | Xu |
| 2018/0163497 | A1 | 7/2018 | Younger |
| 2018/0202248 | A1 | 7/2018 | Harrington et al. |
| 2018/0202249 | A1 | 7/2018 | Harrington et al. |
| 2018/0238132 | A1 | 8/2018 | Oag et al. |
| 2018/0274356 | A1 | 9/2018 | Hazel |
| 2018/0283836 | A1 | 10/2018 | Thomas |
| 2018/0305993 | A1 | 10/2018 | Perkins et al. |
| 2019/0017356 | A1 | 1/2019 | Harrington et al. |
| 2019/0106956 | A1 | 4/2019 | Wells |
| 2019/0106962 | A1 | 4/2019 | Lee et al. |
| 2019/0128657 | A1 | 5/2019 | Harrington et al. |
| 2019/0136673 | A1 | 5/2019 | Sullivan et al. |
| 2019/0162057 | A1 | 5/2019 | Ashton et al. |
| 2019/0277103 | A1 | 9/2019 | Wells et al. |
| 2019/0368293 | A1 | 12/2019 | Covalt et al. |
| 2020/0018132 | A1 | 1/2020 | Ham |
| 2020/0032603 | A1 | 1/2020 | Covalt et al. |
| 2020/0095838 | A1 | 3/2020 | Baker |
| 2020/0362652 | A1 | 11/2020 | Eitschberger et al. |

FOREIGN PATENT DOCUMENTS

| | | | |
|---|---|---|---|
| CA | 2980935 | A1 | 10/2016 |
| CA | 3040116 | A1 | 10/2016 |
| CA | 3022946 | A1 | 11/2017 |
| CA | 3050712 | A1 | 7/2018 |
| CA | 2980935 | C | 11/2019 |
| CN | 2823549 | | 10/2006 |
| CN | 1284750 | C | 11/2006 |
| CN | 104499977 | A | 4/2015 |
| CN | 104481492 | B | 6/2019 |
| CN | 106522886 | B | 12/2019 |
| EP | 2177866 | A1 | 4/2010 |
| EP | 3077612 | B1 | 5/2020 |
| GB | 2065750 | B | 6/1983 |
| GB | 2537749 | B | 3/2017 |
| RU | 2087693 | C1 | 8/1997 |
| RU | 2204706 | C1 | 5/2003 |
| RU | 30160 | U1 | 6/2003 |
| RU | 2221141 | C1 | 1/2004 |
| RU | 2312981 | C2 | 12/2007 |
| RU | 98047 | U1 | 9/2010 |
| RU | 2439312 | C1 | 1/2012 |
| WO | 1994009246 | A1 | 4/1994 |
| WO | 2008066544 | A2 | 6/2008 |
| WO | 2014178725 | A1 | 11/2014 |
| WO | 2016100064 | A1 | 6/2016 |
| WO | 2016100269 | A1 | 6/2016 |
| WO | 2016161379 | A1 | 10/2016 |
| WO | 2017041772 | A1 | 3/2017 |
| WO | 2017125745 | A1 | 7/2017 |
| WO | 2017192878 | A1 | 11/2017 |
| WO | 2017199037 | A1 | 11/2017 |
| WO | 2018136808 | A1 | 7/2018 |
| WO | 2018213768 | A1 | 11/2018 |
| WO | 2019165286 | A1 | 8/2019 |
| WO | 2019180462 | A1 | 9/2019 |
| WO | 2021013731 | A1 | 1/2021 |
| WO | 2021063920 | A1 | 4/2021 |

OTHER PUBLICATIONS

Jet Research Center, Plugs and Setting Tools, Alvarado,Texas, 13 pgs., https://www.jetresearch.com/content/dam/jrc/Documents/Books_Catalogs/02_Plugs_STNG_Tool.pdf.

Hunting Titan, T-Set Setting Tool Product Catalog, 2015, 87 pgs., http://www.hunting-intl.com/media/1872254/AMG-1054.HT_T-Set_Catalog_LowRes.pdf.

Thru-Tubing Systems, Thru-Tubing Systems Wireline Products Catalog, Apr. 25, 2016, 45 pgs., http://www.thrutubingsystems.com/phire-content/assets/files/Thru%20Tubing%20Systems%20Wireline%20Products.pdf.

Baker Hughes; Power charge, Slow set, Size 10 E4; dated Sep. 18, 2020; https://www.shopbakerhughes.com/wireline/power-charge-slow-set-size-10-e4-h437660010.html; 4 pages.

(56) References Cited

OTHER PUBLICATIONS

Baker Hughes; Power charge, Standard, Size 20 E4; dated Sep. 20, 2020; https://www.shopbakerhughes.com/wireline/power-charge-standard-size-20-e4-h437643223.html; 4 pages.
Baker Hughes, E-4 Wireline Pressure Setting Assembly and BHGE C Firing Heads, Mar. 8, 2018, 16 pages.
Halliburton; Wireline and Perforating Advances in Perforating; dated Nov. 2012; 12 pages.
Hunting Energy Services, Hunting T-Set Animation Web Video Screenshot, 2015, 1 page.
Hunting, T-Set® Family of Setting Tools, 2 pages.
Hunting, T-Set® Tool Catalog, Sep. 27, 2016, 87 pages.
International Searching Authority; International Search Report and Written Opinion of the International Searching Authority for PCT/EP2020/077180; dated Jan. 28, 2021; 13 pages.
United States Patent and Trademark Office, Office Action of U.S. Appl. No. 16/858,041, dated Jun. 16, 2020, 11 pgs.

* cited by examiner

REVERSE BURN POWER CHARGE FOR A WELLBORE TOOL

CROSS-REFERENCE TO RELATED APPLICATIONS

This application claims the benefit of U.S. Provisional Patent Application No. 62/853,824 filed May 29, 2019, the entire contents of which are incorporated herein by reference.

BACKGROUND OF THE DISCLOSURE

Oil and gas are extracted by subterranean drilling and introduction of tools into the resultant wellbore for performing various functions. The work performed by tools introduced in a wellbore may be achieved by a force exerted by expanding gases; the expanding gases may be the result of combustion of an energetic material.

One example of a wellbore tool is a setting tool. Among other functions, a setting tool is utilized to place plugs at locations inside the wellbore to seal portions of the wellbore from other portions. The force exerted to set a plug is typically exerted on a piston in the setting tool, with the piston acting to deform or displace portions of the plug which then engage the walls of the wellbore. The engagement of the wellbore wall by the deformed portions of the plug hold the plug, as well as any elements attached to the plug, stationary in the wellbore. The plug and any associated elements may completely or partially seal the wellbore, and the associated elements may function to vary this complete/partial blockage depending upon circumstances.

Primarily used during completion or well intervention, a plug may pressure isolate a part of the wellbore from another part. For example, when work is carried out on an upper section of the well, the lower part of the wellbore must be isolated and plugged; this is referred to as zonal isolation. Plugs can be temporary or permanent. Temporary plugs can be retrieved whereas permanent plugs can only be removed by destroying them with a drill. There are number of types of plugs, e.g., bridge plugs, cement plugs, frac plugs and disappearing plugs. Plugs may be set using a wire-line, coiled tubing, drill pipe or untethered drones. In a typical operation, a plug can be disposed into a well and positioned at a desired location in the wellbore. A setting tool may be attached to and lowered along with the plug or it may be lowered after the plug, into an operative association therewith.

The expanding gases in a tool typically result from a chemical reaction involving a power charge. In the example of a setting tool, activation of the chemical reaction in the power charge results in a substantial force being exerted on the setting tool piston. When it is desired to set the plug, the self-sustaining chemical reaction in the power charge is initiated, resulting in expanding gas exerting a substantial force on the piston. The piston being constrained to movement in a single direction, the substantial force causes the piston to move axially and actuate the plug to seal a desired area of the well. The substantial force exerted by the power charge on the piston can also shear one or more shear pins or similar frangible members that serve certain functions, e.g., holding the piston in place prior to activation and separating the setting tool from the plug.

The force applied to a tool by the power charge must be controlled; it must be sufficient to actuate the tool reliably but not so excessive as to damage the downhole tools or the wellbore itself. Also, even a very strong force can fail to properly actuate a tool if delivered too abruptly or over too short a time duration. Even if a strong force over a short time duration will actuate a tool, such a set-up is not ideal. That is, a power charge configured to provide force over a period of a few seconds or tens of seconds instead of a few milliseconds is sometimes required and the desired option. In the context of a setting tool, such an actuation is referred to as a "slow set". Depending on the particular function of a given tool and other parameters, favorable force characteristics may be provided by a force achieving work over a period of milliseconds, several seconds or even longer.

FIG. 1 shows a power charge 116 contained in a prior art generic wellbore tool 60. A chemical reaction in power charge 116 results in expanding gas exerting a force 86 on a piston 80 or other force transferring element. The piston 80, in turn, exerts an actuation force 84 to accomplish a function of the generic tool 60. Initiation of the chemical reaction, e.g., combustion, begins at a section of power charge 116 remote from piston 80 and the chemical reaction proceeds in a direction 88 toward piston 80. A problem in the prior art is that the portion of the power charge 116 that has not undergone the chemical reaction may block the expanding gas from exerting the force 86 on piston 80. Thus, expanding gas pressure will increase until it is able to exert a force on the piston 80 and begin moving the piston 80 to exert the actuation force 84 to achieve the function of the generic tool 60.

In view of the disadvantages associated with currently available power charges, there is a need for a safe, predictable and economical power charge for use in wellbore tools. The improved power charge will reduce extraneous forces developed during the chemical reaction, i.e., a much-improved force/time profile will be achieved. Such improvements may result in smaller power charges being required and reduced maximum forces within the tool; both of these results will reduce the likelihood of inadvertent damage to the tool.

BRIEF DESCRIPTION OF THE EXEMPLARY EMBODIMENTS

In an aspect, the disclosure is directed to a power charge for actuating a wellbore tool in a wellbore. An exemplary power charge has a first end and a second end opposite the first end and includes therein a first volume containing a first energetic material and a second volume containing a second energetic material positioned within the first energetic material. The second energetic material is a faster burning material compared to the first energetic material. The second energetic material may combust at a higher rate than the first energetic material, and thereby begin building gas pressure within the wellbore tool in a slow set fashion.

In another aspect, the disclosure is directed to a wellbore tool including a power charge for actuating the wellbore tool. An exemplary wellbore tool includes a tool body wall that defines a power charge cavity. The power charge is positioned within the power charge cavity and includes a first volume containing a first energetic material and a second volume containing a second energetic material positioned within the first energetic material. The second energetic material is a faster burning material compared to the first energetic material. An initiator holder is also positioned within the power charge cavity and is configured for receiving and positioning an initiator adjacent to the power charge within the power charge cavity, to ignite one of the first energetic material and the second energetic material and thereby cause combustion of the power charge.

In another aspect, the disclosure is directed to a method for actuating a wellbore tool with a power charge. An exemplary method includes providing the wellbore tool including a power charge cavity defined by a tool body wall of the wellbore tool, and the power charge and an initiator holder positioned within the power charge cavity. The exemplary power charge includes a first volume containing a first energetic material and a second volume containing a second energetic material positioned within the first energetic material. The second energetic material is a faster burning material compared to the first energetic material. The initiator holder is configured for receiving and positioning an initiator adjacent to the power charge within the power charge cavity. The method further includes inserting the initiator into the initiator holder and initiating the initiator. Initiating the initiator initiates an ignition portion of the power charge causing combustion of the first energetic material and the second energetic material and generation of gas pressure from combustion of the first energetic material and the second energetic material. The gas pressure is used to actuate the wellbore tool.

BRIEF DESCRIPTION OF THE DRAWINGS

A more particular description will be rendered by reference to specific exemplary embodiments thereof that are illustrated in the appended drawings. Understanding that these drawings depict only exemplary embodiments thereof and are not therefore to be considered to be limiting of its scope, the exemplary embodiments will be described and explained with additional specificity and detail through the use of the accompanying drawings in which.

Figure 1:
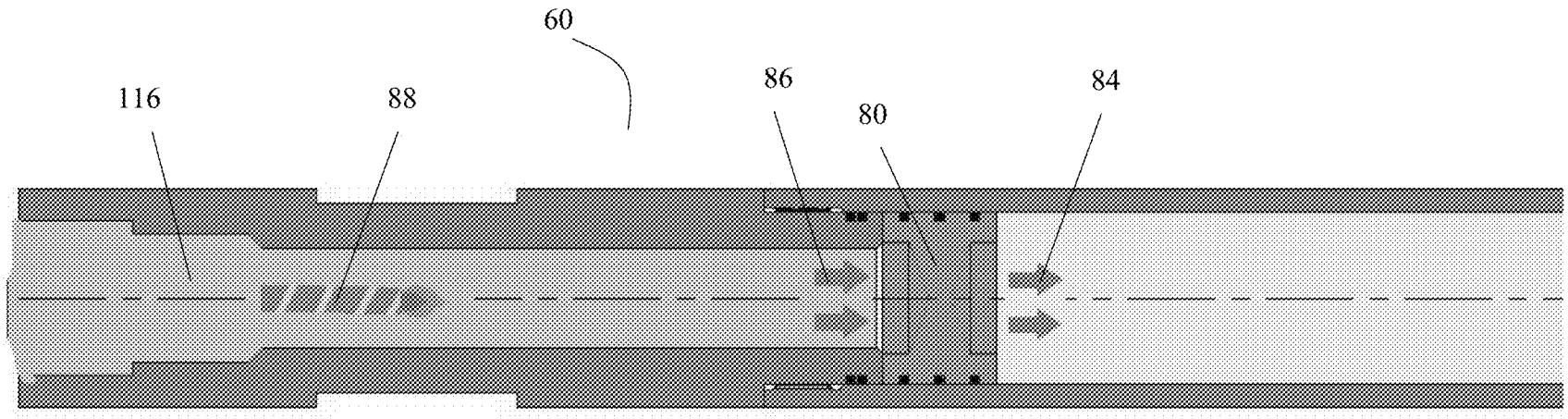
FIG. 1 (Prior Art)
FIG. 1 is a cross-sectional, side, plan view of a generic prior art wellbore tool that utilizes a power charge to perform work.

Various features, aspects, and advantages of the exemplary embodiments will become more apparent from the following detailed description, along with the accompanying figures in which like numerals represent like components throughout the figures and text. The various described features are not necessarily drawn to scale but are drawn to emphasize features of the exemplary embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various exemplary embodiments. Each example is provided by way of explanation and is not meant as a limitation and does not constitute a definition of all possible embodiments.

In the description that follows, the terms "setting tool", "mandrel", "initiator", "power charge", "piston", "bore", "apertures" and/or "channels"; and other like terms are to be interpreted and defined generically to mean any and all of such elements without limitation of industry usage. Such terms used with respect to exemplary embodiments in the drawings should not be understood to necessarily connote a particular orientation of components during use.

As used herein, the term "cylinder" includes cylinders and prisms having a base of any shape. In addition, collections of cylinders having different base shapes and sizes stacked together are also encompassed by the term "cylinder".

Figure 2:
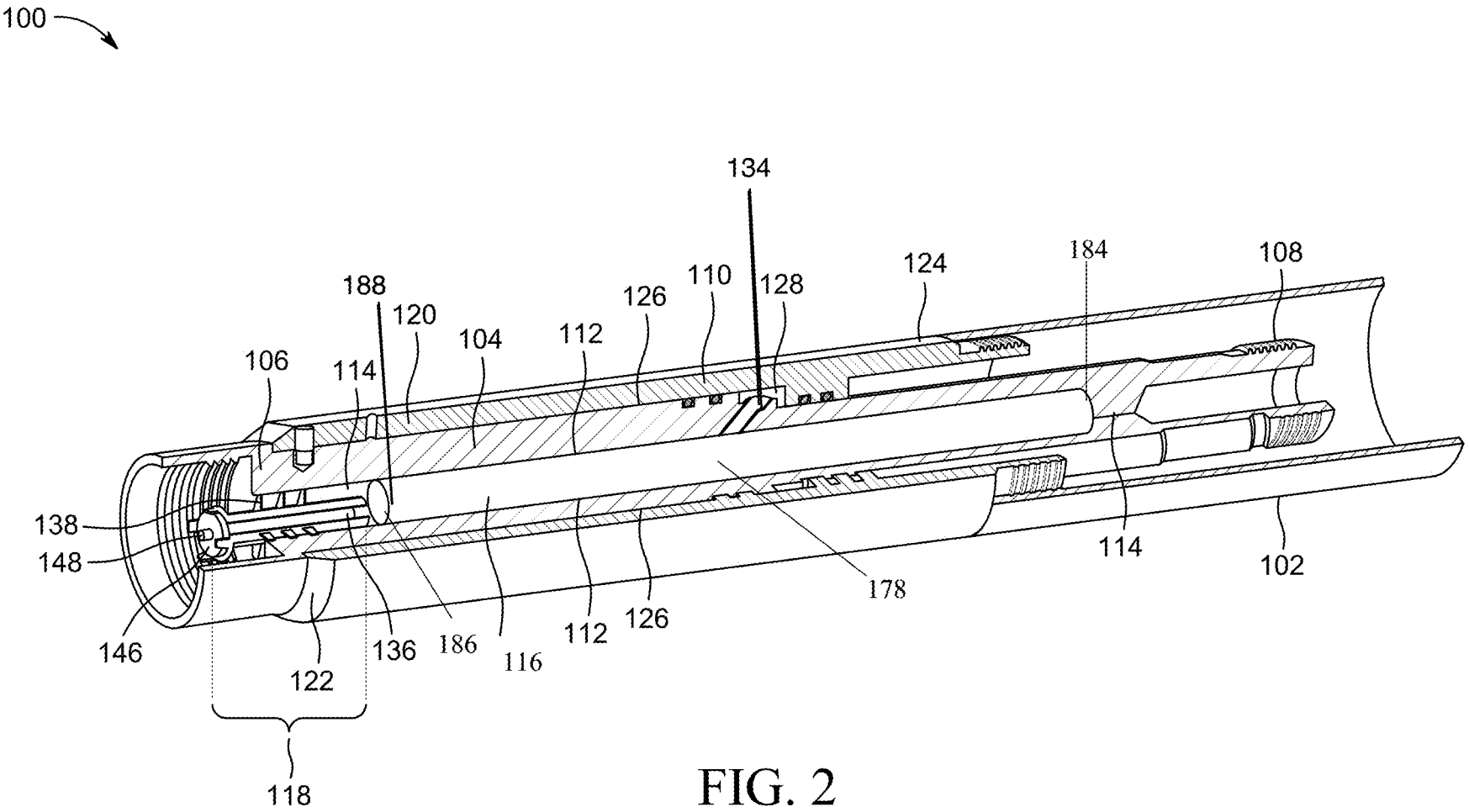
FIG. 2 is a one-quarter-sectional, side, perspective view of a setting tool in accordance with an exemplary embodiment.
Figure 3:
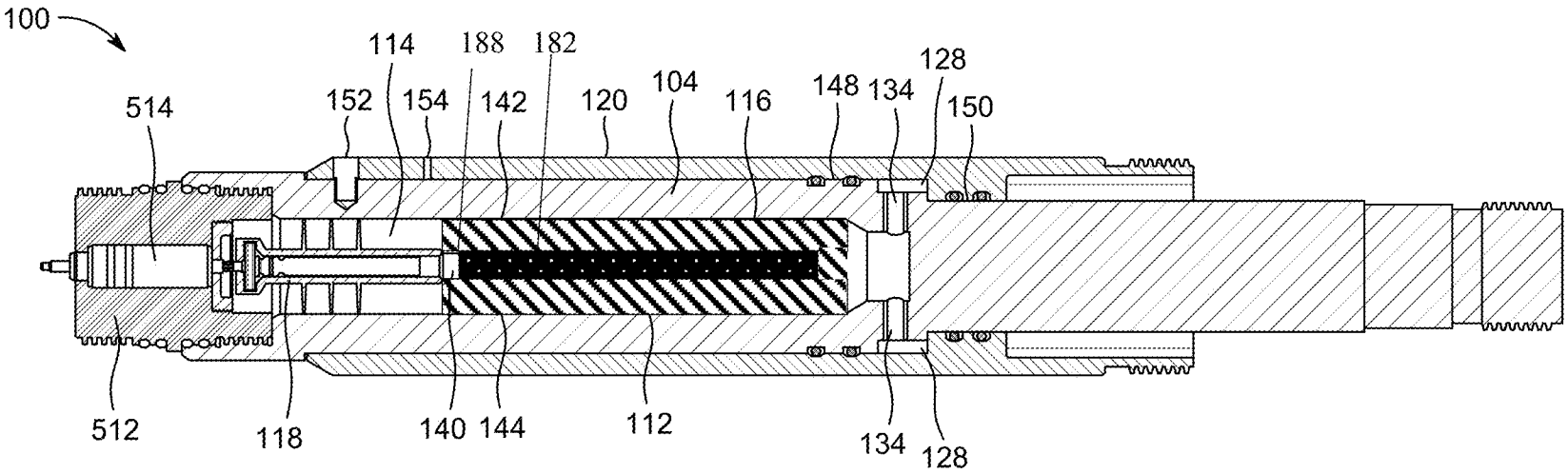
FIG. 3 is a cross-sectional, side, plan view of a setting tool in accordance with an exemplary embodiment.

For purposes of illustrating features of the exemplary embodiments, examples will now be introduced and referenced throughout the disclosure. Those skilled in the art will recognize that these examples are illustrative and not limiting and are provided purely for explanatory purposes. For example, the exemplary embodiments presented in FIGS. 2 and 3 show the use of a power charge 116 in exemplary setting tools. Although shown in the context of a setting tool 100, the power charge 116 presented herein may be utilized in any wellbore tool capable of being actuated by expanding gas from a chemical reaction, e.g., combustion. U.S. patent application Ser. No. 16/858,041 filed Apr. 24, 2020, which is commonly owned by DynaEnergetics Europe GmbH and incorporated herein by reference in its entirety, provides additional details regarding setting tools.

FIG. 2 illustrates a perspective, partial quarter-sectional view of an exemplary setting tool 100 for actuating a tool 102 in a wellbore. The setting tool 100 includes an inner piston 104 having a proximal end 106 and a distal end 108. An intermediate section of the inner piston 104 has an annular wall 112 enclosing a cavity 114. The cavity 114 is configured to receive a power charge 116 therein. The power charge 116 is not shown in cross section. Thus, only the external surface of power charge 116 is shown in FIG. 2. An initiator 118 may be positioned proximate to the power charge 116. The initiator 118 is used to initiate combustion of the power charge 116 to form a combustion gas pressure inside the cavity 114.

Another component of setting tool 100 is an outer sleeve 120 having a piston proximal end 122, a piston distal end 124, a body 110, and a central bore 126. The outer sleeve 120 is configured to slideably receive the inner piston 104. A generally annular expansion chamber 128 may be defined by a portion of the central bore 126 of the outer sleeve 120 and a portion of the annular wall 112 of the inner piston 104. A gas diverter channel 134 extends through the annular wall 112 of the inner piston 104. The gas diverter channel 134 is configured to allow gas pressure communication between the cavity 114 containing power charge 116 and the expansion chamber 128. Accordingly, in the circumstance where the combusting portion of the power charge 116 has an unimpeded gas pressure path to channel 134, the combustion gas will pass through the gas diverter channel 134 and into the expansion chamber 128. Increasing amounts of gaseous combustion products from burning power charge 116 will increase the pressure in the cavity 114, the gas diverter channel 134 and the expansion chamber 128. Expansion chamber 128 is so named because it is adapted to expand in volume as a result of axial movement of the outer sleeve 120 relative to the inner piston 104. The increasing gas pressure in the expansion chamber 128 will exert an axial force on outer sleeve 120 and inner piston 104, resulting in the outer sleeve 120 sliding axially toward tool 102 and expansion chamber 128 increasing in volume.

Referring again to FIG. 2, the initiator 118 is configured for positioning in an initiator holder 138. Initiator 118 may be of the type described in U.S. Pat. No. 9,605,937 issued Mar. 28, 2017, which is commonly owned by DynaEnergetics Europe GmbH and incorporated herein by reference in its entirety, and comprise an initiator head 146 and an initiator shell 136. The initiator shell 136 may contain an electronic circuit board (not shown) and an element, e.g., a fuse head (not shown), capable of converting an electrical signal into an ignition, flame or pyrotechnical output. Initiator head 146 includes an electrically contactable line-in portion 148 through which electrical signals may be conveyed to the electronic circuit board of initiator 118.

The initiator holder 138 may be configured for positioning the initiator shell 136 adjacent the power charge 116 within the inner piston 104. The initiator 118 is positioned sufficiently close to power charge 116 such that ignition of the initiator 118 will initiate combustion of power charge 116.

In accordance with an embodiment, power charge 116 occupies a volume of a cylinder, typically an elongated cylinder having an initiation end 186 and a distal end 184 with the volume 178 of the power charge 116 between the initiation end 186 and the distal end 184. The initiation end 186 includes an ignition portion 188 of the power charge 116, i.e., the place where combustion of the power charge 116 is initiated. Combustion of the power charge 116 will proceed from the ignition portion 188 through the volume of the power charge 178 in any direction where unreacted energetic material is sufficiently close to reacting, i.e., burning, energetic material. Therefore, combustion of the power charge 116 will generally proceed from the initiation end 186 to the distal end 184 of the power charge. The rate at which combustion will proceed in the power charge 116 is discussed hereinbelow. The exothermic chemical reaction, e.g., combustion or burning, in the power charge 116 results in replacement of the solid energetic material of the power charge volume 178 with gas and a small amount of particulate residual material. Since the cavity 114 is sealed by sub 512 and bulkhead 514 (FIG. 3), it has a fixed volume. Thus, the gas produced by the exothermic chemical reaction results in increasing gas pressure within the cavity 114.

In current setting tool wellbore tools, a path does not initially exist for gas pressure from the combustion gas produced early in the combustion of power charge 116 to reach the gas diverter channel 134. A time delay occurs before such a gas pressure path is opened. The pressure built up in the cavity 114 prior to a path to the gas diverter channel 134 being opened is delivered in a single pulse of a short burst of high force. Thus, current setting tools often have problems delivering a "slow set", i.e., a force over a period of seconds to minutes instead less than a second or, perhaps, less than several seconds. Thus, the favorable force characteristics achievable with a slow set may be difficult or impossible to achieve with currently available wellbore tools.

The most commonly used energetic material, i.e., chemical reactant resulting in expanding gas, is black powder. Black powder, also known as gunpowder, is the earliest known chemical explosive and includes sulfur, charcoal and potassium nitrate (saltpeter, $KNO_3$). The sulfur and charcoal act as fuels while the saltpeter is an oxidizer. Because of the amount of heat and gas volume that it generates when burned, black powder has been used as a propellant for about 1000 years in firearms, artillery, rockets, and fireworks, and as a blasting powder in quarrying, mining, and road building. Black powder is referred to as a low explosive because of its slow reaction rate relative to high explosives and consequently low brisance. Low explosives deflagrate, i.e., burn, at subsonic speeds in contrast to a supersonic wave generated by the detonation of high explosives. Ignition of black powder generates gas. When generated in a closed and constant volume, the increased amount of gas result in increased pressure in the closed volume. The force of this increased pressure in a closed volume may be utilized to perform work.

There exist a number of 'substitutes' for black powder. Various parameters may be reduced or enhanced in a black powder substitutes ("BPS"). For example, the sensitivity as an explosive may be reduced while the efficiency as a propellant may be increased. The first widely used BPS was Pyrodex®. Pyrodex® will produce a greater amount of gas per unit mass than black powder but has a reduced sensitivity to ignition. Both of these parameters may be considered improvements over black powder. Triple Seven® and Black Mag3® are sulfurless BPS that burn more quickly and develop greater pressure.

Rate of burn for black powder and BPS is a notoriously difficult parameter to measure or on which to find accurate data. This is possibly because of the number of variables that can have an effect on the rate of burn, i.e., black powder and BPS will burn at different rates depending upon a number of factors. Regardless, pure black powder and BPS will usually have a burn rate on the order of about 0.3 to about 0.7 feet per second ("ft/sec") which may be converted to about 18 feet per minute to about 42 feet per minute ("ft/min"). Mixing black powder or BPS with additives that are not fuel or oxidizer components contributing to the chemical reaction, i.e., "inert" ingredients, will typically slow the burn rate. Further, the higher the proportion of inert ingredients to black powder or BPS, the slower the burn rate will be.

The burn rate of a mixture containing black powder or BPS may be adjusted from very near the burn rate of pure black powder or BPS, i.e., by adding very little inert material, to very much slower, i.e., by adding a large proportion of inert material. Formulations for the power charge 116 for use in a wellbore tool are known that have a burn rate on the order of about 12 ft/min down to about 0.5 ft/min or even lower. Thus, a fast-burning portion of the power charge may contain 50 to 100% black powder or BPS and 0 to 50% potassium nitrate ($KNO_3$).

In an embodiment, a formulation for a slow-burning power charge may contain about 6% by weight of black powder or BPS, sodium nitrate ($NaNO_3$) as fuel, wheat flour ($C_6H_{10}O_5$) as oxidizer and an epoxy resin as a binder. Varying the ratio of epoxy resin provides a means of varying the burn rate for the power charge 116. In addition, the selection of epoxy resin may have an impact on the burn rate. In an embodiment, a power charge permitting a slow-set are formulated to produce burn rates from about 3 ft/min to about 0.13 ft/min. The slow-burning portion of the power charge may contain 40 to 75% sodium nitrate ($NaNO_3$), 0 to 10% black powder or BPS, 15 to 45% wheat flour, and 10 to 30% epoxy.

Utilizing the 18 ft/min to 42 ft/min values for pure black powder or BPS and power charge formulations with values of 3 ft/min to about 0.13 ft/min results in relative burn rates from about 6:1 to about 300:1. In an embodiment, relative burn rates between a fast reacting energetic material and a slow reacting energetic material between about 100:1 and 300:1 are contemplated.

As stated previously, a problem with current wellbore tools is that a path does not initially exist for gas pressure from the combustion gas produced early in the combustion of power charge 116 to reach the gas diverter channel 134. Thus, regardless of the reaction rate of the energetic material, a time delay occurs before the gas pressure is able to exert a force where it is needed. Also, the pressure built up in the cavity 114 prior to a path to the gas diverter channel 134 being opened is delivered as a short burst of high force.

In an embodiment, a power charge 116 is presented that opens the path from the combustion gas created by the burning power charge 116 to the portions of the wellbore tool upon which a force needs to be exerted far earlier in the combustion process than in the prior art. For the wellbore tools presented in FIG. 2 and FIG. 3, this path includes the gas diverter channel 134 and the portions of the wellbore tool where force is exerted are the portions of the outer sleeve 120 and the inner piston 104 forming expansion chamber 128.

Figure 4:
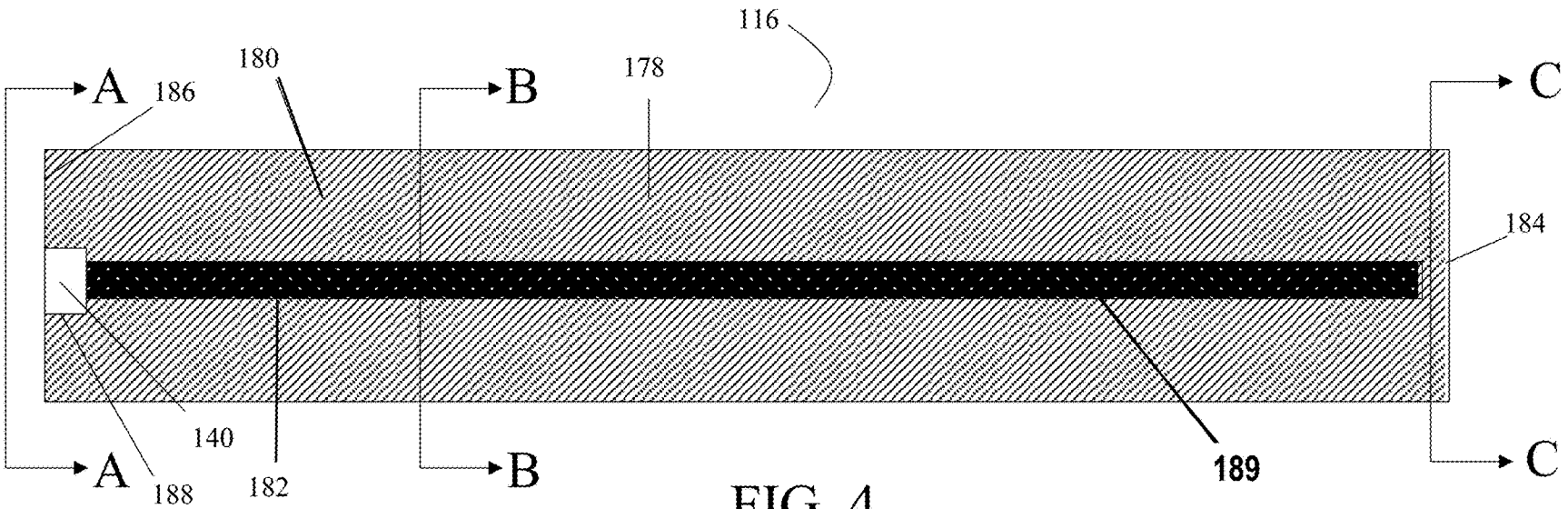
FIG. 4 is a cross-sectional, side, plan view of a power charge in accordance with an exemplary embodiment.

FIG. 4 illustrates a cross-section of the power charge in accordance with an embodiment. The outer dimensions of the power charge 116 may be identical to those found in the prior art, thus permitting its use in existing generic wellbore tools 60. The portion 180 that forms the majority of power charge 116 of FIG. 4 is a slow-burning formulation of energetic material, e.g., a power charge formulation with a burn-rate on the order of about 1 ft/min to about 0.13 ft/min. A portion 182 of power charge 116 is a relatively fast-burning energetic material. For example, the portion 182 may be pure black powder or BPS and have a burn rate on the order of about 18 ft/min up to about 42 ft/min. Each of the slow-burning portion 180 and the fast-burning portion 182 occupy a separate volume of the power charge 116. Further, the volume of the slow-burning portion 180 is continuous and the volume of the fast-burning portion 182 continuous, i.e., there exists one and only one volume of each in a single power charge.

Figure 5C:
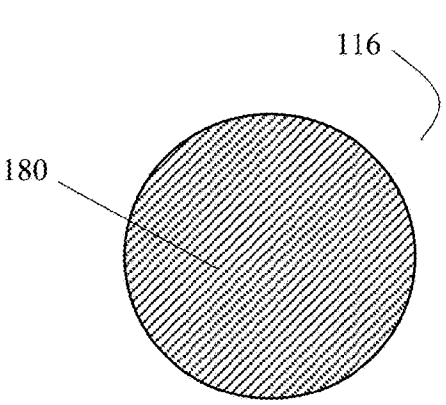
FIG. 5C is a cross-sectional, plan view of the power charge shown in FIG. 4 taken at line C-C.
Figure 5B:
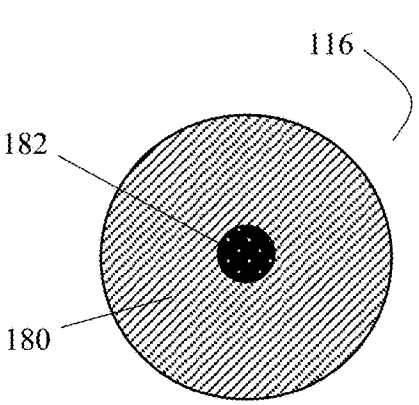
FIG. 5B is a cross-sectional, plan view of the power charge shown in FIG. 4 taken at line B-B.
Figure 5A:
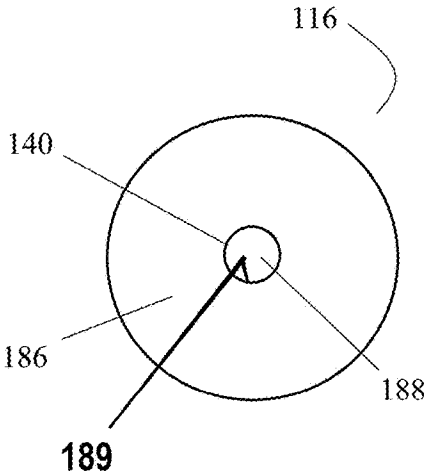
FIG. 5A is an end, plan view of the power charge power charge shown in FIG. 4 viewed from the perspective of line A-A.

With continuing reference to FIGS. 3 and 4, and further reference to FIG. 5A, the slow-burning portion 180 volume of the power charge 116 may define the fast-burning portion 182 volume of the power charge 116 such that the fast-burning portion 182 volume is a chamber formed within the slow-burning portion 180 volume. For example, as in the exemplary power charge(s) shown in FIGS. 3 and 4, the cylindrically shaped power charge 116 may include the slow-burning portion 180 volume formed as an elongate annular member. The fast-burning portion 182 volume may be the open inner area of the annulus, i.e., the chamber formed within the slow-burning portion 180 volume, defined and bounded by an inner annulus surface 189. The fast-burning energetic material may be filled, packed, inserted, etc. in the chamber. Alternatively, the fast-burning energetic material may be formed as a core of the power charge 116 such that the fast-burning energetic material and the slow-burning energetic material are arranged together and formed into the power charge 116 without discrete or delineated portions. The chamber, or the fast-burning portion 182 volume, generally, may extend along any length within the slow-burning portion 180 volume including all the way therethrough, or may otherwise be formed by any technique to occupy any particular volume, of any particular profile or configuration, consistent with this disclosure.

Further, in various alternative embodiments, the power charge 116 may have any geometry, cross-sectional profile, arrangement, and the like including the incorporation and configuration of the slow-burning portion 180 volume and the fast-burning portion 182 volume consistent with this disclosure and as particular applications may dictate.

FIG. 5A illustrates the end of the power charge 116 shown in FIG. 4 designed to cause ignition portion 188 to be disposed adjacent the initiator 118 when power charge 116 is properly inserted in power charge cavity 114, according to an embodiment. FIG. 5B is a cross-sectional view of the power charge 116 shown in FIG. 4 showing the relationship between the slow-burning portion 180 and the fast-burning portion 182. FIG. 5C is a cross-sectional view of the power charge 116 shown in FIG. 4 showing a portion of thereof having only slow-burning energetic material, i.e., lacking fast-burning portion 182.

Ignition of the initiator 118 adjacent ignition portion 188 will initiate combustion of both the slow-burning portion 180 and the fast-burning portion 182 of the power charge 116 shown in FIG. 4. The different burn rates of the portion 180 and the portion 182 results in combustion of the fast-burning portion 182 occurring much more quickly than the combustion of the portion 180. The fast and slow-burn rates differing by a factor in the range of about a hundred to several hundred times, portion 182 will be completely consumed in the time that only a small portion of portion 180 has been consumed. As with any energetic material used in a power charge, once consumed, the volume previously occupied by the energetic material is now occupied primarily by gas. The volume previously occupied by the energetic material becomes part of the path for pressurized gas to access the expansion chamber 128. Thus, the relatively fast combustion of the fast-burning portion 182 quickly opens a path through the power charge 116 that would have taken substantially longer to open if the combustion of the slow-burning portion 180 were relied upon to open the path. Once opened, the path for pressurized gas formerly occupied by fast-burning portion 182 causes the combustion gases and, thus, gas pressure from the combustion of slow-burning portion 180 to be conveyed past the unreacted portion of the slow-burning portion 180.

Thus, the current problem of pressure build-up being delivered as an excessively strong single pulse to the gas diverter channel is avoided with the provision of a fast-burning portion 182 through some or all of the slow-burning portion 180. Rather, depending upon the different combustion rates between the slow-burning portion and fast-burning portion 182 of the power charge 116, only a relatively small pressure build-up will occur prior to a path being opened to the gas diverter channel 134 or other access route to the area in the wellbore tool where mechanical work is achieved, e.g., expansion chamber 128. In the embodiments shown in FIG. 2 and FIG. 3, the axial force exerted on outer sleeve 120 will be increased relatively gradually after fast-burning portion 182 is fully consumed, thus enabling a simple and economical means of achieving slow set delivery of force by setting tool 100 on tool 102.

As illustrated in FIG. 3, FIG. 4 and FIG. 5A, the power charge 116 may further include an indentation 140 adjacent the initiator 118 and/or initiator holder 138. By providing a slight offset between initiator 118 and the surface of power charge 116, the indentation 140 is configured to increase the reliability that the initiator 118 initiates the combustion of the power charge 116. Further, indentation 140 may be filled or lined with a booster charge (not shown), the chemical makeup of the booster charge being more sensitive to initiation than the chemical makeup of either or both the fast-burning and slow-burning portions of the power charge 116.

Figure 6:
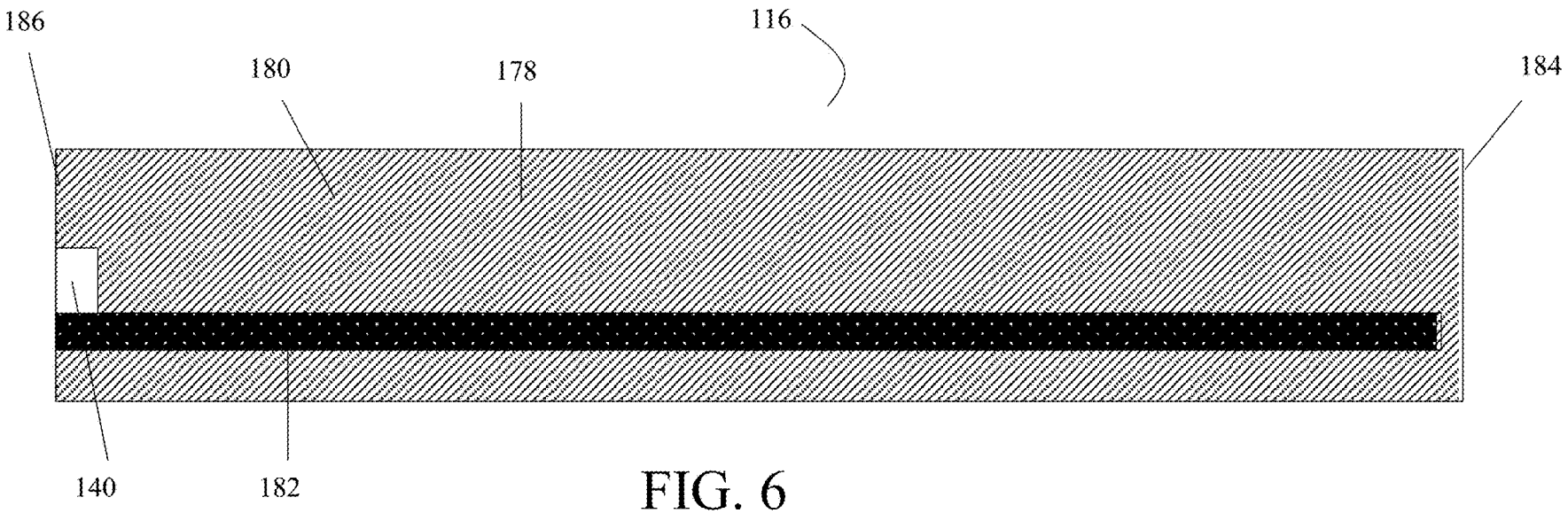
FIG. 6 is a cross-sectional, side, plan view of a power charge in accordance with an exemplary embodiment.

Although the figures, particularly FIG. 4 and FIG. 5B, show the fast-burning portion 182 as approximately coaxial to the remainder of the power charge 116, this geometry is one option. FIG. 6 illustrates an embodiment where the fast-burning portion 182 is radially offset from the axis of the power charge 116. The geometry of FIG. 6 may be selected to decrease the distance between the fast-burning portion 182 and the gas diverter channel 134 or other access route to the area in the wellbore tool where mechanical work is achieved is located. The possibility exists that the fast-burning portion 182 may be completely consumed but the reaction still needs to consume the slow-burning portion 180 to complete the path for pressurized gas to the gas diverter channel 134. The geometry of FIG. 6 can be one solution to this issue. Another solution to this issue is to have the fast-burning portion 182 approach very close to or even meet the distal end 184 of power charge 116. The fast consumption of the fast-burning portion 182 relative to the slow-burning portion 180 will, thus, result in a path through the entirety (or substantially the entirety) of the power charge 116 before a substantial portion of the portion 180 has been consumed. For example, in an exemplary embodiment in which the slow burning portion 180

In the exemplary embodiment illustrated in FIG. 3, the single use setting tool 100 may include a shear element 152 connected to the inner piston 104 and the outer sleeve 120. The shear element 152 may be configured to prevent the axial sliding of the outer sleeve 120 relative to the inner piston 104. The shear element 152 allows the axial sliding of the outer sleeve 120 relative to the inner piston 104 subsequent to the formation of the combustion gas in the expansion chamber 128 exceeding a threshold pressure. That is, once the gas pressure in expansion chamber 128 reaches a threshold pressure, the force pushing axially against outer sleeve 120 will cause failure of shear pin 152. The outer sleeve 120 will then be free to move axially relative to inner piston 104. In the context of the power charge 116 embodiments described herein, the force to shear the shear element 152 can be set higher than the greatly reduced initial force from burning of energetic material prior to a path to the gas diverter channel 134 being opened. Thus, the shear element 152 prevents the initial gas build-up from having any effect on the ultimate work performed by the wellbore tool.

The exemplary single use setting tool 100 may also include a gas bleed 154 positioned such that after gas pressure in the expansion chamber 128 has moved the outer sleeve 120 and inner piston 104 relative to one another to a point where gas bleed 154 moves past a first seal assembly 148, the gas bleed 154 may vent excess pressures in the expansion chamber 128 and the central bore 126 of the outer sleeve 120, through the body 110 of the outer sleeve 120. A second seal assembly 150 seals the outer sleeve 120 to the inner piston 104 such that the expansion chamber 128 is sealed on both ends and gas pressure may build up therein.

Figure 7:
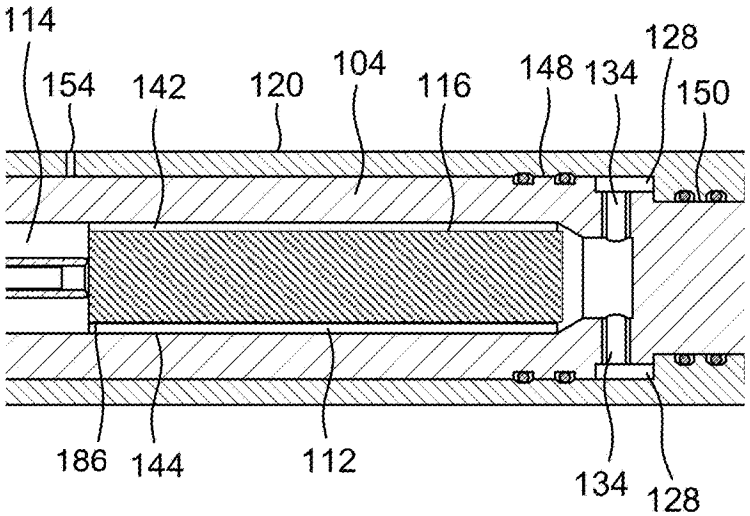
FIG. 7 is a cross-sectional, side, plan view of a portion of a setting tool in accordance with an exemplary embodiment.

In an embodiment, either or both the power charge 116 and the power charge cavity 114 may have a gas pressure path formed therein before any combustion is initiated. FIG. 7 shows a side cross-sectional detail view of the power charge cavity 114 portion of a setting tool 100. The setting tool 100 of FIG. 7 includes one or more grooves 142 disposed at an intersecting surface 144 between the power charge 116 and the annular wall 112 of cavity 114. The one or more grooves 142 may extend axially along a substantial portion of the intersecting surface 144. The groove 142 is configured to allow gas pressure communication between the proximal, initiation end 186 of power charge 116, where combustion begins, and the expansion chamber 128 via the gas diverter channel 134.

Figure 8:
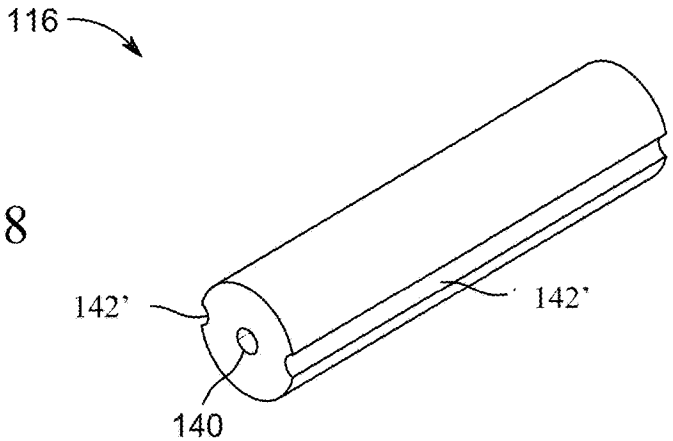
FIG. 8 is a side, perspective view of a power charge in accordance with an exemplary embodiment.

The groove 142 may be formed in the power charge 116 or the annular wall 112 of the setting tool cavity 114. FIG. 7 shows a set of grooves 142 present in the annular wall 112 of the power charge cavity 114. A standard, cylindrical power charge 116 disposed in the power charge cavity of 114 of FIG. 7 will have a gas pressure path, in the form of grooves 142, linking the initiation end 186 of the power charge 116 to the expansion chamber 128 via the gas diverter channel 134. The power charge shown in FIG. 8 does not have a standard cylindrical shape. Rather, FIG. 8 shows a power charge 116 in which two axial grooves 142' have been formed into the outer surface thereof. The power charge 116 shown in FIG. 8 inserted in the power charge cavity 114 of tool 100 will have a gas pressure path, in the form of grooves 142', linking the initiation end 186 of the power charge 116 to the expansion chamber 128 via the gas diverter channel 134. Grooves 142 and 142' may also be formed in both the annular wall 112 of the power charge cavity 114 and the power charge 116 itself.

Thus, grooves 142 and/or 142' provide an immediate or far earlier gas pressure path from the combusting initiation end 186 of the power charge 116 to the gas diverter channel 134. Like the fast-burning portion 182, the grooves 142, 142' prevent a large build-up of gas pressure in cavity 114 that is blocked from reaching gas diverter channel 134 by unburned power charge 116. Thus, the current problem of pressure build-up being delivered as a single pulse may be reduced with grooves 142, 142'. Rather, the axial force exerted on outer sleeve 120 may be increased relatively gradually, over the course of seconds (or any particular amount of time as applications dictate and the design of the cavity 114, the power charge 116, and the gas diverter channels 134, among other things, may accomplish), thus enabling a simple and economical means of achieving slow set delivery of force in a wellbore tool.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a"

(or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make variations and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include structural elements with insubstantial differences from the literal language of the claims.

What is claimed is:

1. A power charge for actuating a wellbore tool, the power charge comprising:

a first end and a second end opposite the first end;

a first volume comprising a first energetic material;

a path formed within the first energetic material for directing pressurized gas out of the power charge; and a second volume comprising a second energetic material, the second energetic material filling at least a portion of the path;

wherein:

the second energetic material is a faster burning material compared to the first energetic material;

the path extends from within the first energetic material to an environment external to the power charge; and burning of the second energetic material opens the path for the conveyance of the pressurized gas from the burning of the first energetic material out of the power charge.

2. The power charge of claim 1, wherein the second volume extends from a position adjacent the first end towards the second end.

3. The power charge of claim 1, wherein the second volume extends from a position adjacent the first end to a position adjacent the second end.

4. The power charge of claim 3, wherein the second volume extends all the way through the power charge from the first end to the second end.

5. The power charge of claim 1, wherein the second volume is coaxial with the first volume.

6. The power charge of claim 1, further comprising an indentation in the power charge adjacent the first end.

7. The power charge of claim 6, further comprising a booster positioned within the indentation.

8. The power charge of claim 6, wherein the second volume extends from position adjacent the indentation, in a direction away from the indentation.

9. The power charge of claim 1, wherein the power charge includes a groove formed in an outer surface of the power charge.

10. A wellbore tool including a power charge for actuating the wellbore tool, comprising:

a tool body wall defining a power charge cavity, wherein the power charge is positioned within the power charge cavity and the power charge includes:

a first volume comprising a first energetic material;

a gas flow path formed within the first energetic material for directing pressurized gas out of the power charge; and a second volume comprising a second energetic material, the second energetic material filling at least a portion of the gas flow path;

wherein:

the second energetic material is a faster burning material compared to the first energetic material;

the path extends from within the first energetic material to an environment external to the power charge; and burning of the second energetic material opens the gas flow path for the conveyance of the pressurized gas from the burning of the first energetic material out of the power charge; and an initiator holder positioned within the power charge cavity and configured for receiving and positioning an initiator adjacent to the power charge within the power charge cavity.

11. The wellbore tool of claim 10, wherein the initiator holder is configured for positioning an initiating output portion of the initiator adjacent to an ignition portion of the power charge.

12. The wellbore tool of claim 11, wherein the ignition portion of the power charge includes the first energetic material or the second energetic material.

13. The wellbore tool of claim 12, wherein the ignition portion of the power charge includes the second energetic material and the initiator holder is configured for positioning the initiating output portion of the initiator adjacent to the second volume.

14. The wellbore tool of claim 11, wherein the power charge further includes an indentation in the power charge and a booster positioned within the indentation, wherein the initiator holder is configured for positioning the initiating output portion of the initiator adjacent to the booster.

15. The wellbore tool of claim 10, further comprising a channel open to and extending, through the tool body wall, from the power charge cavity to an outside of the tool body wall.

16. The wellbore tool of claim 15, wherein the gas flow path is open to the channel.

17. A method for actuating a wellbore tool with a power charge, comprising:

providing the wellbore tool including a power charge cavity defined by a tool body wall of the wellbore tool, and the power charge and an initiator holder positioned within the power charge cavity, wherein:

the power charge includes:

a first volume comprising a first energetic material;

a path formed within the first energetic material for directing pressurized gas out of the power charge; and a second volume comprising a second energetic material, the second energetic material filling at least a portion of the path;

the second energetic material is a faster burning material compared to the first energetic material;

the path extends from within the first energetic material to an environment external to the power charge;

burning of the second energetic material opens the path for the conveyance of the pressurized gas from the burning of the first energetic material out of the power charge; and the initiator holder is configured for receiving and positioning an initiator adjacent to the power charge within the power charge cavity;

inserting the initiator into the initiator holder; and initiating the initiator and thereby initiating an ignition portion of the power charge causing combustion of the first energetic material and the second energetic material and generation of gas pressure from combustion of the first energetic material and the second energetic material, wherein the gas pressure actuates the wellbore tool.

18. The method of claim 17, wherein the tool body wall includes a channel open to and extending, through the tool body wall, from the power charge cavity to an actuation chamber of the wellbore tool, and the gas pressure builds up in the actuation chamber to actuate the wellbore tool.

19. The method of claim 17, wherein the second energetic material combusts at a rate that is higher than a rate at which the first energetic material combusts.

* * * * *